US012179254B2

(12) United States Patent
Dériaz et al.

(10) Patent No.: US 12,179,254 B2
(45) Date of Patent: Dec. 31, 2024

(54) APPARATUS AND METHOD FOR PROFILING WORKPIECES BY COLD FORMING

(71) Applicant: Ernst Grob AG, Männedorf (CH)

(72) Inventors: Daniel Dériaz, Meilen (CH); Ekrem Kapkin, Rapperswil (CH); Jan Schmid, Bubikon (CH)

(73) Assignee: ERNST GROB AG, Männedorf (CH)

( * ) Notice: Subject to any disclaimer, the term of this patent is extended or adjusted under 35 U.S.C. 154(b) by 663 days.

(21) Appl. No.: 17/287,645

(22) PCT Filed: Nov. 14, 2019

(86) PCT No.: PCT/EP2019/081280
§ 371 (c)(1),
(2) Date: Apr. 22, 2021

(87) PCT Pub. No.: WO2020/099536
PCT Pub. Date: May 22, 2020

(65) Prior Publication Data

US 2021/0394250 A1 Dec. 23, 2021

(30) Foreign Application Priority Data

Nov. 15, 2018 (CH) ..... 1419/18

(51) Int. Cl.
*B21H 1/20* (2006.01)
*B21D 53/28* (2006.01)

(52) U.S. Cl.
CPC ..... *B21H 1/20* (2013.01); *B21D 53/28* (2013.01)

(58) Field of Classification Search
CPC ... B21H 1/20; B21H 1/22; B21H 3/04; B21H 3/042; B21H 3/048; B21H 5/02; B21H 7/14; B21H 7/18; B21D 53/28
(Continued)

(56) References Cited

U.S. PATENT DOCUMENTS 136,620 A * 3/1873 Richardson ..... B21H 1/22 72/188
2,715,846 A * 8/1955 Grob ..... B21H 5/02 29/890.048
(Continued)

FOREIGN PATENT DOCUMENTS

CN 102083566 A 6/2011
CN 102470418 A 5/2012
(Continued)

OTHER PUBLICATIONS

Taiwanese Office Action dated Nov. 15, 2022 issued in corresponding Taiwanese application (3 pages).

*Primary Examiner* — Christopher L Templeton
*Assistant Examiner* — Teresa A Guthrie
(74) *Attorney, Agent, or Firm* — Rankin, Hill & Clark LLP

(57) ABSTRACT

A workpiece executes a rotation movement about a longitudinal axis and is machined by a tool in a multitude of reshaping engagements, in which an active region of the tool comes into contact with the machining region. The tool is held by a tool holder. The tool holder is mounted in an orbiting body so as to be rotatable about a rotation axis and is driven to carry out a rotating movement about the rotation axis, and is driven to carry out an orbiting movement by the orbiting body. Rotation movement of the workpiece is synchronised with the orbiting movement of the tool holder and the rotating movement of the first tool holder is synchronised with the orbiting movement of the tool holder.

18 Claims, 6 Drawing Sheets

(58) Field of Classification Search
USPC ..... 72/80, 83, 95, 100, 102, 107, 110, 119, 72/122, 126; 29/893.32
See application file for complete search history.

(56) References Cited

U.S. PATENT DOCUMENTS

| | | | | | |
|---|---|---|---|---|---|
| 4,651,551 | A | | 3/1987 | Bishop et al. | |
| 4,872,250 | A | * | 10/1989 | De Marco | B21D 53/28 72/193 |
| 5,001,916 | A | * | 3/1991 | Schuler | B21B 1/42 72/100 |
| 5,355,706 | A | * | 10/1994 | Deriaz | B21H 5/025 72/83 |
| 7,562,549 | B2 | * | 7/2009 | Deriaz | B21H 5/02 72/107 |
| 2009/0126440 | A1 | | 5/2009 | Ziesel et al. | |

FOREIGN PATENT DOCUMENTS

| | | | | |
|---|---|---|---|---|
| CN | 106256460 | A | | 12/2016 |
| DE | 1073996 | | | 1/1960 |
| DE | 3400315 | A1 | | 9/1984 |
| DE | 10 2014 002 971 | | | 9/2015 |
| EP | 0 344 117 | | | 11/1989 |
| GB | 716930 | A | * | 10/1954 |
| JP | 49-24787 | Y1 | | 7/1974 |
| JP | 61-123440 | A | | 6/1986 |
| JP | 6-154927 | A | | 6/1994 |
| JP | 2001030018 | | * | 2/2001 |
| WO | 2005/075125 | | | 8/2005 |
| WO | 2005/075127 | | | 8/2005 |
| WO | 2007/009267 | | | 1/2007 |
| WO | 2014/061330 | | | 4/2014 |

* cited by examiner

APPARATUS AND METHOD FOR PROFILING WORKPIECES BY COLD FORMING

BACKGROUND OF THE INVENTION

Field of the Invention

The invention relates to the field of the production of profilings, in particular by way of cold reshaping (also referred to as cold forming), for example in rotationally symmetrically solid or hollow parts.

Description of Related Art

Different methods for profiling solid or hollow parts in a cold-reshaping manner are known from the state of the art.

For example, it is known to provide hollow parts with a profiling in a single step by way of a non-profiled sheet-metal part being reshaped by an apparatus which includes a multitude of tools which are distributed over a periphery and which on inserting the sheet-metal part into the apparatus engages into the sheet-metal part where profile gaps are to be produced. A corresponding method for manufacturing an inner-toothed and/or outer-toothed pot-like sheet-metal part with teeth running to the middle axis of the pot is known for example from DE102014002971 A1.

The disadvantage with such methods is the fact that they are very inflexible, since for example a change of the profile gap shape renders necessary a replacement of all tools, and a reconfiguration to the machining of sheet-metal parts with another diameter necessitates the creation of a new, correspondingly adapted apparatus.

In other cold reshaping methods, workpieces are periodically machined in a hammering manner by way of tools driven to carry out an orbiting movement, for producing a profiling, as is known for example from WO 2005/075125 A1. This method is very flexible in its application, since a reconfiguration to other products or changed product specifications is possible with very low effort. On the other hand, a continuation of a profiling up to close to a shoulder, which projects radially outwards to a great extent, is not easily possible with the method that is known from WO 2005/075125 A1 on account of the orbiting movement of the tools.

A method that permits a profiling to be produced in a workpiece up to close to (right up to) an outwardly projecting shoulder of the workpiece is known, for example, from WO 2007/009267 A1. In the method described therein, a cylindrical, thin-walled hollow part which is seated on an outer-profiled mandrel is provided, in a cold-reshaping manner, with a profiling which runs essentially parallel to the longitudinal axis of the hollow part, by way of at least profiling tool being brought to act upon the hollow part in an abrupt hammering manner from the outside radially to the longitudinal axis of the hollow part. Herein, the profiling tool is brought to act upon the surface of the hollow part in an oscillating manner in a direction perpendicular to the longitudinal axis, thus by way of a radially running, linear to and fro movement. Given a constant radial feed depth, the profiling tool is displaced axially relative to the hollow part until the desired profiling length is reached, wherein the machining of the hollow part can be begun on an outwardly projecting shoulder of the hollow part.

Given particularly high demands on the surface quantity, it can be necessary for a post-machining of the hollow part to be carried out subsequently to the method according to WO 2007/009267 A1, since the hollow part with each engagement is only machined by the profiling tool in a short axial section which can result in a slight, scale-like roughness.

SUMMARY OF THE INVENTION

It is an object of the invention to provide a method for manufacturing a profile body having a profiling, and also corresponding apparatuses, which do not have the aforementioned disadvantages.

For example, it should be rendered possible to reconfigure the method or the apparatus for the manufacture of other products or for realising changed product specification, in a simple and inexpensive manner.

A further possible object of the invention is to permit a profile creation with a particularly high surface quality.

A further possible object of the invention is to permit a profile creation with a particularly high productivity.

A further possible object of the invention is to permit a profiling up to close to a workpiece projection, for example up to close to an outwardly projecting shoulder of the workpiece which is to be profiled.

A further possible object of the invention is to permit a profiling between two profiling delimitation structures and right up to these.

In the method, a tool holder and with this a tool which is held by the tool holder is driven to carry out a complex movement which includes at least two components, specifically an orbiting movement, for example along an orbiting path, similarly to a planet, and a rotating movement about its own axis. Herein, these two movements are synchronised with one another. The orbiting movement can be a periodic movement. A corresponding drive device can be provided for producing the rotating movement.

By way of the orbiting movement, the tool holder and thus also the tool can be periodically led up to a workpiece to be machined and can act upon this in a reshaping manner and remove itself from the workpiece again, in order to subsequently approach this again, etc. For example, the tool can be brought into reshaping engagement with the workpiece once per orbit (or also with each second or each third orbit).

By way of the rotating movement about its own axis together with the orbiting movement, the tool can carry out a tool movement on the workpiece, said tool movement including a rolling movement. The tool can therefore include an active region which executes an at least partly rolling movement in a machining region of the workpiece. The tool movement can include a rolling and a sliding movement component.

An engagement of the tool with the workpiece can therefore take place periodically (due to the orbiting movement) during a time duration, and within this time duration, in which the tool (more precisely: the active region of the tool) is in contact with the workpiece, the tool rotates about the rotation axis of the tool holder, so that (during the mentioned time duration) a movement of the tool (tool movement) on the workpiece takes place. Hence different locations of the active region successively come into contact with different locations of the machining region during a reshaping engagement. This for example is in contrast to a hammering machining as is known for example from the mentioned WO 2005/075125 A1 and WO 2007/009267 A1, where it is quasi only a momentary contact between the tool and the workpiece which takes place, and where with the engagements of the tool with the workpiece, the complete active region of the tool simultaneously comes into contact with the workpiece.

A high surface quality can be achieved by way of this, since the workpiece, during a single engagement, can be machined along a large part of the axial profile extension to be produced. In particular, a machining of the workpiece essentially along the complete extension of the axial profiling to be produced can take place during a single engagement. Accordingly, a post-machining as can be necessary in the case of the method according to WO 2007/009267 A1 given particularly high demands on the surface quality can be avoided, since the machining is not composed of a multitude of individual machining steps along the axial profile extension, the machining steps being axially displaced to one another and overlapping one another only to a small extent. A higher productivity can also be achieved by way of this due to the significantly lower number of tool engagements which are to be carried out.

And due to the rotating movement about its own axis together with the mentioned synchronisation, one can effectuate that the tool is brought into engagement with the workpiece in each case in a desired or predefined azimuthal alignment, for example always in the same azimuthal alignment or more precisely: always in the same azimuthal range. A change of the azimuthal alignment of the tool (imparted by the tool holder) take space during each engagement on account of the mentioned rotating movement; and the azimuthal alignment changes over the time duration of the engagement, for example in the same manner with each engagement of the tool.

For example, the rotating movement of the tool holder can be synchronised with the orbiting movement of the tool holder in such a way that the tool runs through the same azimuthal orientations in each of the reshaping engagements.

The terms azimuth and azimuthally in the present text, inasmuch as not is stated to the contrary, relate to the rotation axis of the tool holder.

The synchronisation permits a useful application of a tool that has a non-rotationally symmetrical shape (with respect to the mentioned rotation axis when the tool is mounted in the tool holder). In particular; a tool that includes an active region, which extends only over an azimuthal sector, can be applied. The tool can therefore be a sectoral tool. This, for example, is in contrast to the rotationally symmetrical tools that are known from WO 2005/075125 A1.

For example, the tool can end subsequently to the active region or be set back in the radial direction (with respect to the mentioned rotation axis) vis-a-vis the active region. On account of this, there can be a free region that extends over an azimuthal range adjacent to the active region.

Such a sectoral tool can be suitable for producing profilings right up to a tool projection. This is in contrast to rotationally symmetrical tools that are known from the mentioned WO 2005/075125 A1 and concerning which the active region extends over the complete periphery, and which moreover also do not execute a defined, let alone synchronised rotating movement. The tool which is put forward herein can include an active region which (with regard to the rotation axis) has a non-rotationally-symmetrical shape.

A free region, which is adjacent to the active region and in which a workpiece projection, for example a workpiece shoulder has space, can face the workpiece after the effected engagement due to rotation of the tool holder about its own rotation axis, so that a reshaping of the tool projection by the sectoral tool can be avoided.

The tool can therefore reshape the workpiece in an at least partly rolling manner as described, with each engagement, until an (azimuthal) end of the active region is reached, and then rotate further about the rotation axis, in order to let the workpiece projection find space in the mentioned free region (without the workpiece projection coming into contact with the tool).

The rotating movement can take place, for example, during the complete orbiting or in a continuous manner. By way of this, one can achieve good synchronisation ability of the rotating movement of the tool holder with the orbiting movement of the tool holder.

For example, the synchronisation of the two movements can be realised mechanically. A mechanical synchronisation device can therefore be provided for this synchronisation. However, the mentioned movements can also be synchronised with one another differently, for example electronically, thus by way of an electronic synchronisation device.

In some embodiment examples, the mentioned synchronisation device, which hereinafter is also denoted as a second synchronisation device, includes a planetary gear. For example, it can include a ring gear as well as a planet gear that runs in the ring gear, wherein the planet gear can represent a part of the tool holder or at least be fixedly connected to the tool holder or co-rotates with the rotating movement of the tool holder about the rotation axis, as well as also participates in the mentioned orbiting movement. The axis of the planet gear can be coaxial to the rotation axis.

On the other hand, the planetary gear can also drive the tool holder for its rotating movement about its rotation axis. The already aforementioned drive device for producing the rotating movement of the tool holder about its rotation axis can therefore include a planetary gear.

A planetary gear that simultaneously produces the rotating movement of the tool holder about its rotation axis and synchronises this rotating movement with the orbiting movement of the tool holder can therefore be provided.

The mentioned, for example planet-like orbiting movement can be imparted upon the tool holder by way of an orbiting body. The tool holder can be mounted in the orbiting body, in particular mounted rotatably about its rotation axis. The orbiting body can, for example, execute a rotation along an orbiting body axis, and the rotation axis of the tool holder is distanced to the orbiting body axis, so that the rotation axis executes an orbiting movement essentially along a circular path.

If the mentioned planetary gear is provided, this orbiting movement can produce the rotating movement of the tool holder, imparted by the planetary gear. For this, the orbiting body axis can be aligned coaxially to an axis of the ring gear. Accordingly, the already aforementioned drive device for producing the rotating movement of the tool holder about its rotation axis can therefore include the orbiting body as well as a planetary gear. Likewise, a drive shaft for driving the orbiting body for its rotation about its orbiting body axis can belong to the mentioned drive device.

A drive shaft for driving the orbiting body for its rotation about its orbiting body axis, additionally to the orbiting body can also belong to a drive device for producing a movement of the orbiting body.

Furthermore, a radial feed of the tool or of the tool holder—perpendicular to a longitudinal axis of the workpiece or of a workpiece holder which holds the workpiece—can be provided so that a deeper and deeper engagement of the tool with the workpiece is rendered possible in the course of the machining. The tool can be fed radially until a desired profile depth is reached.

For example, the radial feed can be realised by way of the orbiting body or in particular an orbiting body axis of the orbiting body being moved to the longitudinal axis, thus in this context undergoes a radial advance.

For example, the orbiting body can be mounted in a profiling head, in particular mounted in the profiling head, so as to be rotatable about its orbiting body axis, and the profiling head is drivable for a movement to the longitudinal axis. Accordingly, the orbiting body whilst it rotates about its orbiting body axis can be moved to the longitudinal axis by way of a drive for the radial feed. And the orbiting body axis can accordingly be moved to the longitudinal axis.

By way of this, the described complex movement of the tool can include yet a further component, specifically the described movement (feed movement) that runs radially to the longitudinal axis. The rotation axis of the tool holder can accordingly execute a movement that results from a circular movement which is superimposed on a linear movement of the centre of the circle, in particular, wherein the linear movement takes place in a plane which is defined by the circular movement.

Furthermore, a rotation movement of the workpiece or of the workpiece holder about the longitudinal axis can be envisaged, for example produced by way of a suitable drive device, for example by way of a torque motor, so that the workpiece can be machined by way of the tool at different positions which are distributed over the periphery of the workpiece. Different profile gaps of the profiling which is to be produced can therefore be produced by way of the tool. As is explained further below, several tools can be provided, so that a single tool (or each of the tools) does not necessarily contribute to the formation of all profile gaps of the profiling. Despite this, one can envisage the tool engaging with the workpiece at each position along the periphery of the workpiece at which a profile gap of the profiling is to be produced, and thus contributes to the formation of all profile gaps of the profiling.

The mentioned rotation movement can include a varying, in particular an at least sectionwise periodically varying rotation speed. The mentioned rotation movement for example can be an intermittent rotation.

One can envisage the rotation speed of the rotation movement of the workpiece or of the workpiece holder including consecutive phases of relative high rotation speed and relatively low rotation speed. In particular, the machining of the workpiece by the tool can take place during phases of relatively low rotation speed. The more slowly the workpiece rotates during the engagement of the tool or the longer the workpiece rotates slowly or is at a standstill in the phases of relatively low rotation speed, the better can a high precision of the finally produced profiling be achieved.

For example, one can envisage the tool machining the workpiece in those phases of the rotation movement, in which the workpiece is at a standstill. For example, one can envisage the tool machining the workpiece in phases of the rotation standstill of an intermittent rotation of the workpiece (rotation standstill has the rotation speed zero).

A synchronisation of the rotation movement of the workpiece holder with the orbiting movement of the tool holder can be envisaged. By way of this, one can ensure that the machining of the workpiece always take space again at the same positions along the periphery of the workpiece.

For example, a corresponding synchronisation device which is furthermore also denoted as the first synchronisation device can be an electronic synchronisation device.

In the aforedescribed embodiment example with a planetary gear and an orbiting body, the first synchronisation device can for example synchronise the drive for the rotation of the workpiece or of the workpiece holder with the drive shaft for driving the orbiting body for its rotation about its orbiting body axis.

In particular, the method can therefore be a method for manufacturing a profile body having a profiling, by way of cold reshaping of a workpiece, wherein the workpiece can include a longitudinal axis and in a machining region can include an outer surface, in which the profiling is to be produced. The outer surface can be extended along the longitudinal axis. In particular, the outer surface can be concentric to the longitudinal axis, for example conical or cylindrical. Other shapes of the outer surface, for example polygonal, for example with prismatic machining regions however are also possible.

Herein, the workpiece executes a rotation movement about the longitudinal axis. And the workpiece, in particular the mentioned outer surface is machined by a tool in a multitude of reshaping engagements that are carried out successively and in each of the reshaping engagements, an active region of the tool comes into contact with the machining region. The corresponding tool movement has already been described further above.

The tool is held by a tool holder, and the tool holder is mounted in an orbiting body, so as to be rotatable about the rotation axis of the tool holder, and is driven to carry out a rotating movement about its rotation axis. And the tool holder is driven by the orbiting body to carry out an orbiting movement; in particular the tool holder is driven by the orbiting body to carry out a movement along an orbiting path.

Furthermore, one can envisage the rotation movement of the workpiece being synchronised with the orbiting movement of the tool holder; and the rotating movement of the tool holder being synchronised with the orbiting movement of the tool holder.

In particular, one can envisage the rotation movement of the workpiece being synchronised with the orbiting movement of the tool holder in such a way that several of the reshaping engagements take place at different positions which are distributed over a periphery of the workpiece. If an outer profile is created, then the mentioned positions can be positions, at which profile gaps of the profiling are to be created. If an inner profiling of the workpiece is to be produced by the method, then the positions can be such positions which lie between neighbouring profile gaps of the inner profiling which are to be created.

And in particular, one can also envisage the rotating movement of the tool holder being synchronised with the orbiting movement of the tool holder in such a way that the tool runs through the same azimuthal orientations in each of the reshaping engagements.

If the rotating movement of the tool holder is synchronised with the orbiting movement of the tool holder in such a way that azimuthal orientations which the tool runs through during the respective reshaping engagement is identical in each of the reshaping engagements, then for example a profiling which goes right up to a profiling delimitation structure, for example a workpiece projection, can be created.

The method can also be seen as a method for profiling a workpiece and/or as a method for producing a profiling in a workpiece.

The workpiece can be a hollow part, in particular a rotationally symmetrical, for example cylindrical hollow part.

The workpiece can be a solid part, in particular a rotationally symmetrical, for example cylindrical solid part.

The workpiece can be a metal workpiece.

The machining region can be a region, in which the profiling is to be produced, thus a region that is to be profiled. The machining region can be an axially limited section of the workpiece, for example an end-piece of a tubular or rod-like workpiece.

The workpiece can include a second region connecting to the machining region. This second region can comprise, adjacent to the machining region, a profiling delimitation structure, for example a workpiece projection, which at least in an (azimuthal) angle region about the longitudinal axis has a radial extension, which is larger than a radial extension of the outer surface in the machining region where this is adjacent to the workpiece projection. The profiling limitation structure can be a profiling obstacle, for example a workpiece shoulder.

A profiling delimitation structure can form an end or a delimitation of the profiling.

The outer surface in the machining region can for example be rotationally symmetrical, for example cylindrical or also conical. The outer surface however can also be designed differently to this, for example in a polygonal manner.

The profiling can be an outer profiling. This can be created in a hollow part or in a solid part. For example, in the case of hollow parts it is also possible for example for an outer profiling and an inner profiling to be produced simultaneously, for example if one envisages the workpiece in its machining region being seated on an outer profiled mandrel. Furthermore, it is also possible for an inner toothing to be produced in a hollow part without simultaneously also producing an outer toothing. One can also envisage the workpiece in its machining region being seated on an outer-profiled mandrel.

The profiling can include a multitude of profile gaps (deepenings of the workpiece in the machining region), which are distributed over the periphery, in particular for example uniformly distributed over the periphery. The profile gaps however can also be irregularly distributed over the periphery.

The orbiting movement of the tool holder can be a continuous movement and in particular can be effected at a constant speed.

The rotating movement of the tool holder can be a continuous movement and in particular can be effected at a constant rotation speed.

In particular, these two speeds can have a constant ratio to one another.

The orbiting movement can be a circular movement.

A trajectory (movement path), which describes the movement of the tool holder, can result from a superposition of the orbiting movement with a movement that is perpendicular to the longitudinal axis (radial movement).

In some embodiments, the orbiting body executes a rotation about an orbiting body axis. The orbiting movement of the tool holder can be produced by way of this. The orbiting movement of the tool holder can take place in a plane that is perpendicular to the orbiting body axis.

The orbiting body axis and the rotation axis can be aligned parallel to one another.

The orbiting movement of the tool holder can take place in a plane, to which the longitudinal axis is aligned in parallel.

The rotation of the orbiting body can include a continuous movement and in particular have a constant rotation speed. And the rotating movement of the tool holder can be a continuous movement and in particular have a constant rotation speed. And these two rotation speeds can have a temporally constant ratio to one another. A synchronisation of these two rotation speeds can be achieved of example by way of a planetary gear, as already described above.

The planetary gear can include a ring gear and a planet gear, which runs in the ring gear. The planet gear can be part of the tool holder. And together with this it can execute the rotating movement. The position of the planet gear can be fixed relative to the position of the tool that is held on the tool holder.

The ring gear can be fixed in a profiling head, in which the orbiting body is mounted, in particular rotatably mounted.

The profiling head can be a bearing housing for receiving or mounting parts of the apparatus. For example

- the orbiting body can be mounted, in particular rotatably mounted;
- a drive for the rotation of the orbiting body can be mounted, and
- a ring gear can be fixed, inasmuch as is present, in the profiling head.

Furthermore, the profiling head can be actively connected to a drive, for example to a linear drive, for the radial feed.

Two profiling heads can also be provided, each with at least one tool, for example with a first tool in a first profiling head and a second tool in a second profiling head. These can be arranged lying opposite one another with respect to the longitudinal axis, for example mirror imaged with respect to a plane which includes the longitudinal axis.

The two profiling heads, in particular including the apparatus parts which are provided in them, such as the orbiting body and the ring gear, can be designed equally or be manufactured according to the same specifications, wherein the movements of the apparatus parts run mirror imaged with respect to a plane which contains the longitudinal axis.

The respective orbiting movements of the two mentioned tools can be different from one another, specifically in particular run mirror-imaged to one another with respect to a plane which contains the longitudinal axis. Herein, the respective orbiting movements of the two mentioned tools can take place in one and the same plane.

The orbiting movement of the first tool (of the first profiling head) can thus be synchronised with the orbiting movement of the second tool (of the second profiling head) in such a way that the reshaping engagements of the two mentioned tools each take place simultaneously.

A mechanical loading of the workpiece holder can be kept low due to the (mirror) symmetrical construction, since the respective forces which are to be directed onto the longitudinal axis essentially mutually cancel one another.

Several tools can also be provided for other reasons and at other locations, for example within the same profiling head.

On the one hand, a single tool holder can hold two or more tools, for example such that their active regions are uniformly distributed azimuthally with respect to the rotation axis of the tool holder.

For example, these tools can reshapingly engage with the workpiece in an alternating manner during consecutive orbits.

An increased service life of the individual tools can result by way of this.

On the other hand, two or more tool holders that each hold (at least) one tool can be provided. The orbiting movements of these tool holders, for example, can describe the same orbiting path; and they can be uniformly distributed along the orbiting path. For example, these tool holders can be uniformly distributed azimuthally with respect to the orbiting body axis.

For example, one engagement with the workpiece can take place per rotation orbit of the orbiting body per tool holder.

By way of this (given an equal number of orbits of the orbiting body) a multiplication of the engagements per time and thus a quicker machining of the workpiece can be achieved. N reshaping engagements can take place during a rotation period of the orbiting body, wherein N specifies the number of tool holders each with (at least) one tool.

If N specifies the number of tool holders each with n tools and two identically (e.g. mirror-imaged) constructed stamping heads are provided, then the machining of the workpiece can take place for example with 2·N·n tools The tools or at least their active regions can be manufactured for example according to the same specifications.

The tool can be a rolling punch.

The tool, connecting (azimuthally) to the active region can include a recess, for example an inwardly directed shoulder. A free region can begin there, said free region for example after the effected engagement providing space for a workpiece projection so that this is not reshaped by the tool.

In the free region, the tool that is mounted by the tool holder can be set back radially with respect to the active region.

In a section through the active region perpendicular to the longitudinal axis during an engagement, the tool can have a shape that corresponds to the negative of the shape of a profile gap of the profiling that is to be produced. In particular, this can be provided when the profiling is or includes an outer profiling. An inner profiling can optionally also be produced simultaneously with the outer profiling—or also not produced.

The active region can be defined in that it is the region of the tool, in which the tool comes into (direct) contact with the workpiece.

If the tool is held by the tool holder, then the tool and the tool holder can have a constant relative position to one another. The tool can co-rotate with the associated tool holder. And if a planet gear which is part of the tool holder is provided, then the relative position of the tool to the planet gear can also be constant.

The tool can be part of a tool insert, which can be fixed on the tool holder.

The apparatus can be an apparatus for manufacturing a profile body having a profiling, by way of cold reshaping a workpiece. For this, the apparatus can include:

- a workpiece holder which is rotatable about its longitudinal axis, for holding the workpiece;
- a drive device for producing a rotation movement of the workpiece holder about the longitudinal axis, in particular wherein the rotation movement is intermittent which is to say has alternating time durations of standstill and time durations of the rotation movement;
- an orbiting body;
- a tool holder for holding a tool, in particular wherein the tool holder is mounted in the orbiting body, so as to be rotatable about a rotation axis of the tool holder;
- a drive device for producing a rotating movement of the tool holder about its rotation axis; and
- a drive device for producing a movement of the orbiting body, by way of which the tool holder can be driven to carry out an orbiting movement, in particular along an orbiting path.

The apparatus can further comprise:

- a first synchronisation device for synchronising the rotating movement of the tool holder with the orbiting movement of the tool holder; and
- a second synchronisation device for synchronising the rotating movement of the tool holder with the orbiting movement of the tool holder.

The drive device for producing a rotation moment of the tool holder about its rotation axis can be at least partly identical to the second synchronisation device. For example, the already described planetary gear on the one hand can be part of this drive device by way of it converting the movement of the orbiting body into the rotating movement of the tool holder, and on the other hand it can be part of the first synchronisation device (or correspond to the first synchronisation device) by way of it coupling the rotating movement of the tool holder to the orbiting movement of the tool holder.

The drive device for producing a movement of the orbiting body can include, for example, a drive spindle. This can also be part of the drive device for producing a rotation moment of the tool holder about its rotation axis, e.g., imparted by the planetary gear.

The orbiting body can be mounted in a profiling head, in particularly rotatably mounted. And this, by way of a drive, can be driven towards the longitudinal axis for the radial feed movement. For example, the drive can be a drive for a movement of the profiling head, which runs perpendicularly to the longitudinal axis.

The first synchronisation device and the second synchronisation device can be one and the same synchronisation device or be completely or partly different to one another.

The first synchronisation device can be configured to ensure that an orbiting frequency of the orbiting movement of the first tool holder is in a fixed (temporally unchanged) ratio to a speed of the rotation movement of the workpiece.

The second synchronisation device can be configured to ensure that an orbiting frequency of the orbiting movement of the tool holder is at a fixed (temporally unchanged) ratio to a speed of the rotating movement of the tool holder.

The apparatus can be configured such that the cold reshaping of the workpiece can take place by way of a multitude of successively carried out reshaping engagements. This can be engagements of one and the same tool or also engagements of several tools.

And the first synchronisation device can be configured to synchronise the rotation movement of the workpiece holder with the orbiting movement of the tool holder in such a way that several of the reshaping engagements take place in each case at different positions that are distributed over a periphery of the workpiece.

The apparatus can be configured such that an active region of a tool (for example of one and the same tool or however also of several tools) comes into contact with the machining region in each of the reshaping engagements. The tool (more precisely: the active region) can herein roll on the outer surface (in the machining region). In each of the reshaping engagements, different locations of the active regions can successively come into contact with different locations of the machining region during a duration of the engagement.

And the second synchronisation device can be configured to synchronise the rotation moment of the tool holder with the orbiting movement of the tool holder in such a way that the tool runs through the same azimuthal orientations in each of the reshaping engagements of the tool.

If several tools or one or several tool holders (each holding at least one of the tools) are provided, one can envisage the second synchronisation device being configured to synchronise the rotating movement of the at least one tool holder with the orbiting movement of the respective tool holder in such a way that each of the tools runs through the same azimuthal orientations in each of the reshaping engagements of the respective tool.

For example, if the profiling that is to be produced includes r profile gaps and the apparatus includes N tool holders, whose orbiting movement describe one and the same orbiting path, then the first synchronisation device can be configured for example in such a way that an $N^{th}$ of a period duration of the orbiting movement is equal to an integer multiple or an $r^{th}$ of the period duration of the rotation movement of the workpiece. By way of this, the engagements take place precisely at the positions along the periphery of the workpiece, where profile gaps are to be produced. In particular, the first synchronisation device can be configured for example in such a way that an $N^{th}$ of a period duration of the orbiting movement is equal to an $r^{th}$ of the period duration of the rotation movement of the workpiece. The engagements each take place at neighbouring profile gap positions by way of this.

The invention encompasses apparatuses with features which correspond to the futures of described methods and vice versa also methods with features which correspond to the features of described apparatuses.

BRIEF DESCRIPTION OF THE DRAWINGS

The subject-matter of the invention is hereinafter explained in more detail by way of embodiment examples and the accompanying drawings. Schematically shown are.

DETAILED DESCRIPTION OF THE INVENTION

Parts which are not essential to some extent are not represented, for a better understanding of the invention. The described embodiment examples are exemplary of the subject-matter of the invention or serve for its explanation and have no limiting effect.

Figure 1:
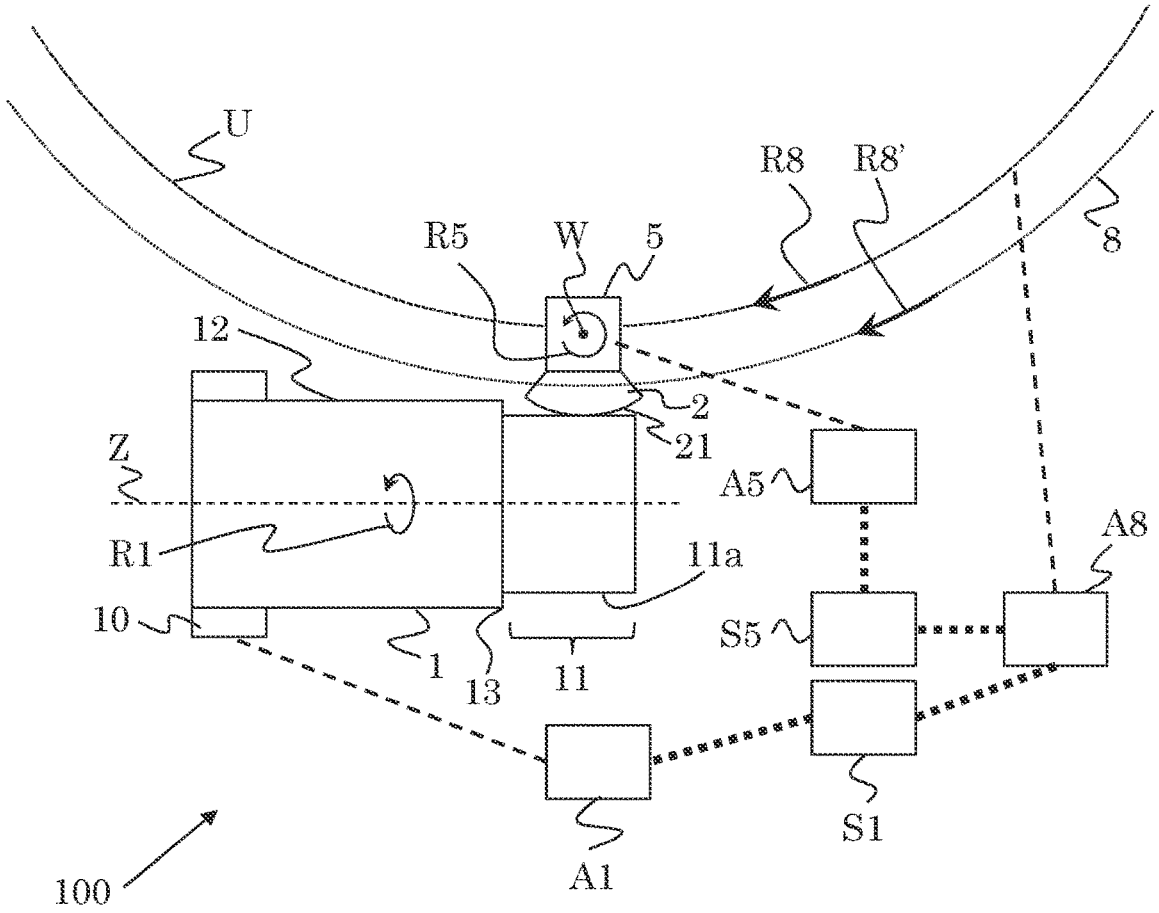
FIG. 1 an apparatus for carrying out the method for the profiling of a workpiece by cold reshaping.

FIG. 1 shows an apparatus 100 for carrying out the method for the cold reshaping profiling of a workpiece 1. The workpiece 1 is held is held in a workpiece holder 10 that is represented symbolically in FIG. 1 and has a longitudinal axis Z, which is simultaneously also a longitudinal axis of the workpiece 1.

In the represented example, the workpiece 1 has a machining region 11 that is rotationally symmetrical with respect to the longitudinal axis Z, is with an outer surface 11*a*, is designed by way of example in a cylindrical manner and in which a profiling is to be produced and onto which a second region 12 connects, in which second region the workpiece 1 has a larger diameter than the machining region 11. By way of this, a profiling delimitation structure, which is designed as a workpiece shoulder 13, is formed between the regions 11 and 12.

An orbiting body 8, which is represented symbolically in FIG. 1, is further provided, the orbiting body executing a movement R8', specifically in the represented example by way of it rotating about an orbiting body axis, which is not represented in FIG. 1 and thus executing a rotation R8'. A tool holder 5, which, on account of the movement R8' of the orbiting body 8, executes an orbiting movement R8 along the orbiting path U, is mounted in the orbiting body 8.

The tool holder 5 includes a rotation axis W, about which the one rotating movement R5 is executed. This rotating movement R5 can be produced for example directly by a drive (rotation drive) or however be derived from the movement R8' of the orbiting body 8, for example in a mechanical manner, for example by way of a planetary gear as is described in yet more detail hereinafter.

The tool holder 5 holds at least one tool 2 that includes an active region 21, in which it comes into cold reshaping contact with the workpiece 1, and specifically by way of it executing a movement which is yet described in more detail hereinafter, during an engagement with the workpiece 1, wherein this movement can be an at least partial rolling movement and can be composed for example of a rolling movement (of the active region on the machining region) and of a sliding movement (of the tool on the workpiece).

Profile gaps can be produced in the workpiece 1 by way of the tool 2, wherein the tool 2 carries out a multitude of engagements per profile gap.

In order for the tool 1 to be able to engage with the workpiece 1 at different positions which are distributed over the periphery of the workpiece 1, the workpiece 1 is drivable about the longitudinal axis Z to carry out a rotation movement R1 by way of the workpiece holder 10, in particular wherein the rotation movement R1 can be an intermittent rotation, so that the tool engagement can take place in a phase of the rotation standstill of the workpiece 1.

Interactions for the purpose of the drive are represented in FIG. 1 by dashed lines, and interactions for the purpose of the synchronisation (which can be realised mechanically and/or electronically) are represented by thickly dotted lines.

A drive device A1 for producing a rotation movement R1 of the workpiece holders 10 is provided, for example a torque motor or other rotation drive as well as a drive device A8 for producing the movement R8' of the orbiting body 8. The drive device A8 can include for example a drive shaft.

Yet a further drive device A5 for producing a rotating movement R5 of the tool holder 5 about is rotation axis W, as already specified above, is yet also provided.

The rotation axis W is aligned parallel to the orbiting body axis. The orbiting movement R8 of the tool holder takes place in a plane, to which the axes are perpendicular. The longitudinal axis is aligned parallel to this plane.

In order for the tool engagements to take place where profile gaps are to be produced, the workpiece rotation R1 and the orbiting movement R8 are synchronised with one another by way of a first synchronisation device S1, for example by way of the workpiece rotation R1 and the movement R8' of the orbiting body 8 being synchronised with one another by way of the first synchronisation device S1.

For example, the synchronisation can lie in the two movements (R1 and R8 or R8') having a constant ratio of their revolving times. For example, if only one tool 2 is provided and consecutive engagements of the tool 2 with the workpiece 1 are to be effected in neighbouring profile gaps, then T8/T1=z can be selected, with an orbiting time (period) T8 of the orbiting movement R8 of the tool holder 5 and an orbiting time (period) T1 of the workpiece, wherein z is the number of the profile gaps that are to be produced.

This synchronisation can be realised for example by way of an electronic synchronisation device S1. Other synchronisation devices, for example mechanical ones, are however basically also conceivable.

Yet a second synchronisation device S5 is further provided, by way of which the rotating movement R5 of the tool holder 5 and the orbiting movement R8 of the tool holder 5 are synchronised with one another. This can be realised for example by way of an electronic synchronisation device, wherein this can then also be identical to the first synchronisation device S1. In the represented example, this synchronisation is realised mechanically, specifically by way of the already mentioned planetary gear.

Inasmuch as this is concerned, the drive device A5 can be at least partly identical to the second synchronization device S5, specifically by way of the planetary gear on the one hand producing the rotating movement R5 and on the other hand effecting the synchronisation between the rotation moment R5 and the orbiting movement R8.

By way of the synchronisation, which is accomplished by way of the second synchronisation device S5, one can succeed in the tool 2 assuming the same azimuthal alignments (with regard to the rotation axis W of the tool holder 5) during each of its engagements with the workpiece 1. This can be advantageous when the workpiece 1, as is represented in FIG. 1, includes an outwardly projecting workpiece shoulder 13 and the profiling is to be created right up to this. This is explained in FIGS. 2A to 2D.

FIGS. 2A-2D illustrate successive phases of the method. Most reference numerals are already explained above; 23 designates a tool recess or a tool shoulder, 22 designates a free region of the tool 2 and φ designates an azimuthal orientation of the tool, with respect to the rotation axis W, or more precisely the respective azimuthal angle (measured in the anticlockwise direction). As is represented in FIGS. 2A-2D (and also in FIG. 4, see below)

- an axis (represented dashed in FIGS. 2A-2*d*), which is aligned perpendicularly to the rotation axis W and which runs through the middle of the active region 21 and through the rotation axis W; and
- an axis (represented dotted in FIGS. 2A-2D). which is aligned perpendicularly to the rotation axis W and which runs through the middle of the active region 21 and through the orbiting body axis can be selected as reference axes for the azimuthal orientation.

Figure 2A:
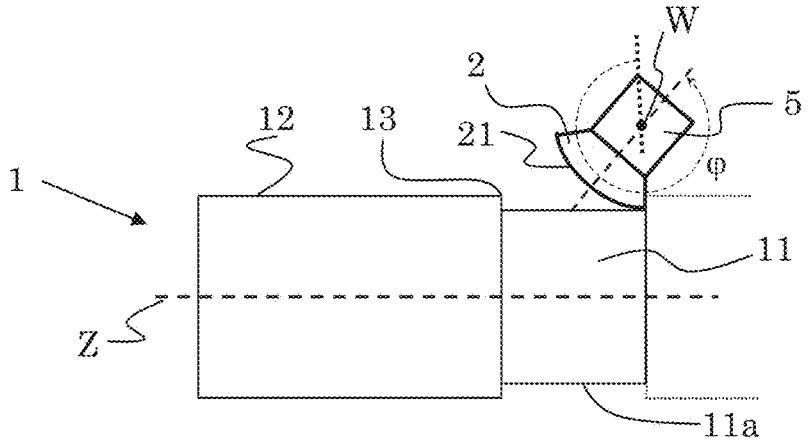
FIGS. 2A-2D successive phases of the method.

FIG. 2A illustrates the situation roughly at the beginning of an engagement, where the tool 2 just comes into contact with the workpiece 1. The azimuthal angle φ in the illustrated example is roughly 317°, corresponding to −43°.

Figure 2B:
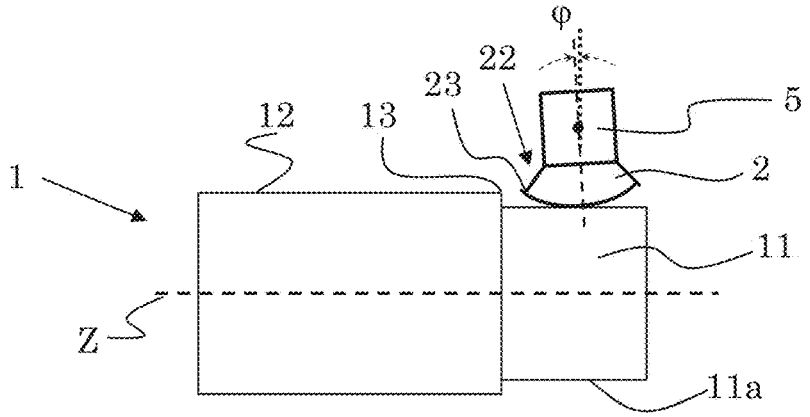

FIG. 2B illustrates the situation roughly in the middle of the engagement. The azimuthal angle φ is a few degrees in the illustrated example.

Figure 2C:
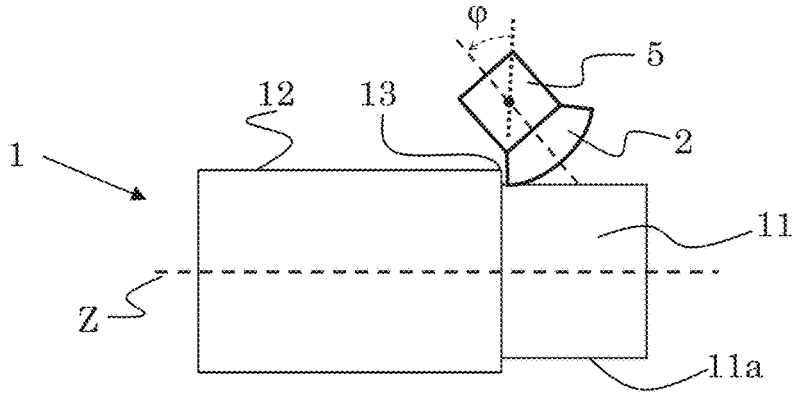

FIG. 2C illustrates the situation roughly at the end of the engagement, where the tool 2 is still only just in contact with the workpiece 1. The azimuthal angle φ is roughly 40° in the illustrated example.

Figure 2D:
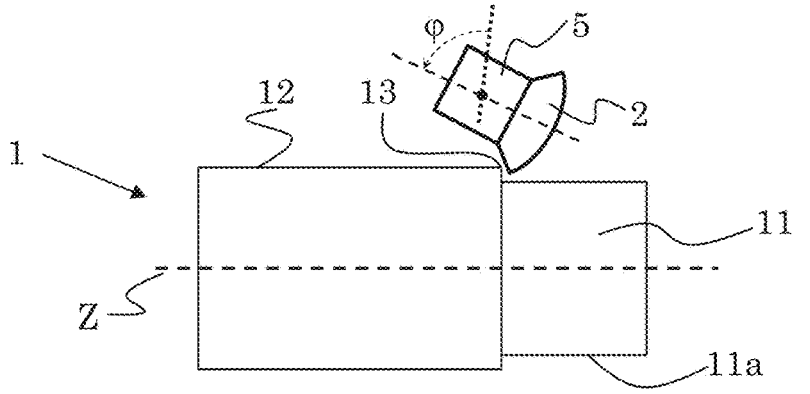

FIG. 2D illustrates the situation shortly after the end of the engagement, wherein the tool 2 just leaves contact with the workpiece 1. The azimuthal angle φ is a good 70° in the illustrated example.

For example, by way of the second synchronisation device S5, one can effectuate the tool 2 running through the azimuthal angle region, here for example from −43° to a good 70° during the engagement with the workpiece 1, with each orbiting.

By way of this, one can prevent the tool 2 from coming into (reshaping) contact with the workpiece shoulder 13—but despite this the formation of the profile can take place right up to the workpiece shoulder 13.

For this purpose, the tool 2 is a sectoral tool. It includes the free region 22, which is subsequent to the active region and in which it is set back radially (with respect to the rotation axis W).

As can be simply recognised from FIG. 2A, the workpiece 1 at the end. which is represented at the right, instead of ending there can include a further workpiece projection (indicated in a dotted manner in FIG. 2A). In such a case, by way of the described method it is possible to produce the profiling between the two workpiece projections such that it extends right up to the respective workpiece projection.

Figure 3:
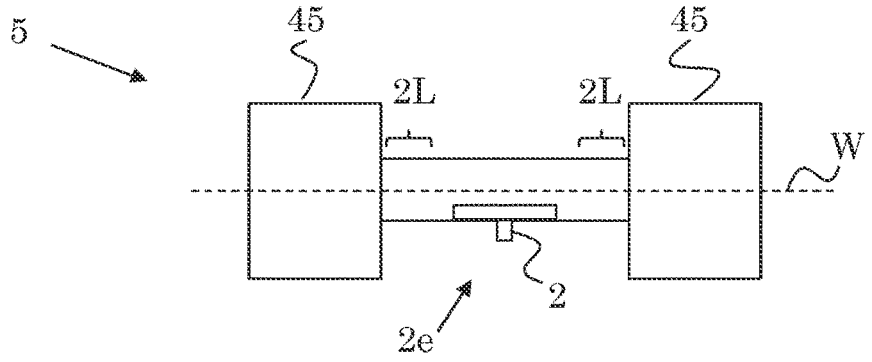
FIG. 3 a tool holder with a tool, in a section through its rotation axis.

FIG. 3 shows a tool holder 5 with a tool 2, in a section through its rotation axis W. It (optionally) includes two planet gears 45, whose axes are coaxial with the rotation axis W, and two bearing regions 2L for the rotatable mounting in the orbiting body 8 (see FIG. 1). The tool holder 5 can be designed as one piece. The tool 2 forms a part of a tool insert 2*e*, which is fixedly connected to the tool holder 5, for example is screwed to this.

The tool 2 can be fastened on the tool holder 5 in a rotationally fixed manner relative to the planet gears 45.

Figure 4:
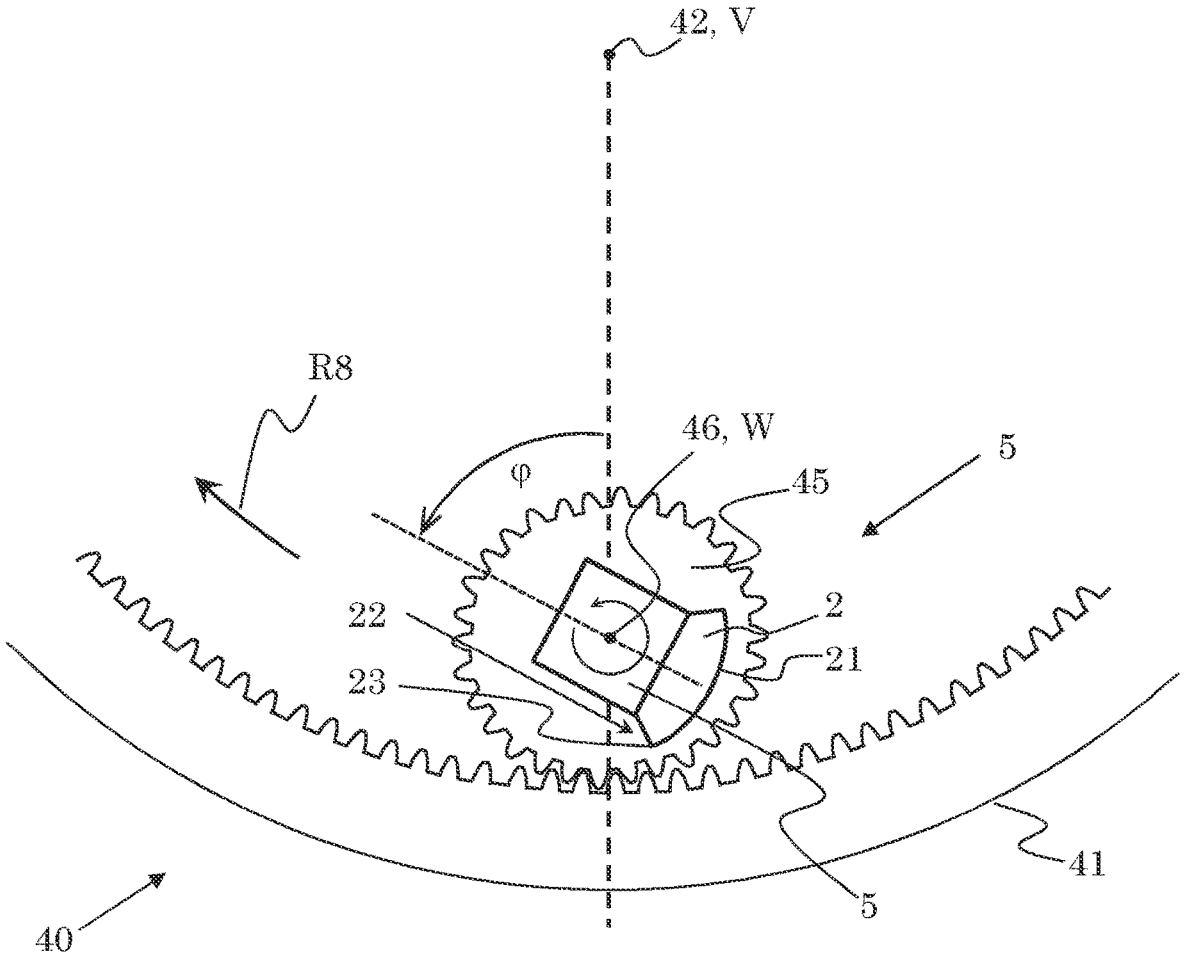
FIG. 4 a detail of the planetary gear with a planet gear, according to FIG. 3.

FIG. 4 in a view onto section perpendicular to the rotation axis W illustrates a detail of a planetary gear 40 of the apparatus, for example including planet gears 45 as are integrated in the tool holder 5 according to FIG. 3, of which however only one is visible in FIG. 4.

The planetary gear 40 includes a ring gear 41 with an axis 42 and apart from this can yet include a second ring gear, which is not represented in FIG. 4 and in which the second planet gear of the tool holder 5 runs.

The axis 46 of the planet gear 45 is coaxial with the rotation axis W. And the orbiting body axis V (corresponding to the axis of the orbiting movements of the tool carrier) is coaxial with the axis 42 of the ring gear 41.

By way of a suitable dimensioning of the planetary gear 40, one can ensure, for example, that with each orbit the tool 2 has the same azimuthal alignment at a certain position along the orbiting path U (see FIG. 1) of the tool carrier 5, for example where the engagement with the workpiece 1 is to be terminated.

Instead of a planetary gear with two ring gears and two planet gears, the planetary gear for example can also be realised with no more than one ring gear and no more than one planet gear.

The mechanical demands on the tool holder 10 can be greatly reduced if two tool engagements take place with each tool engagement, and specifically at locations of the workpiece 1, which lie opposite one another with respect to the longitudinal axis, and in particular also axially (with respect to the longitudinal axis Z) at the same position.

Figure 5:
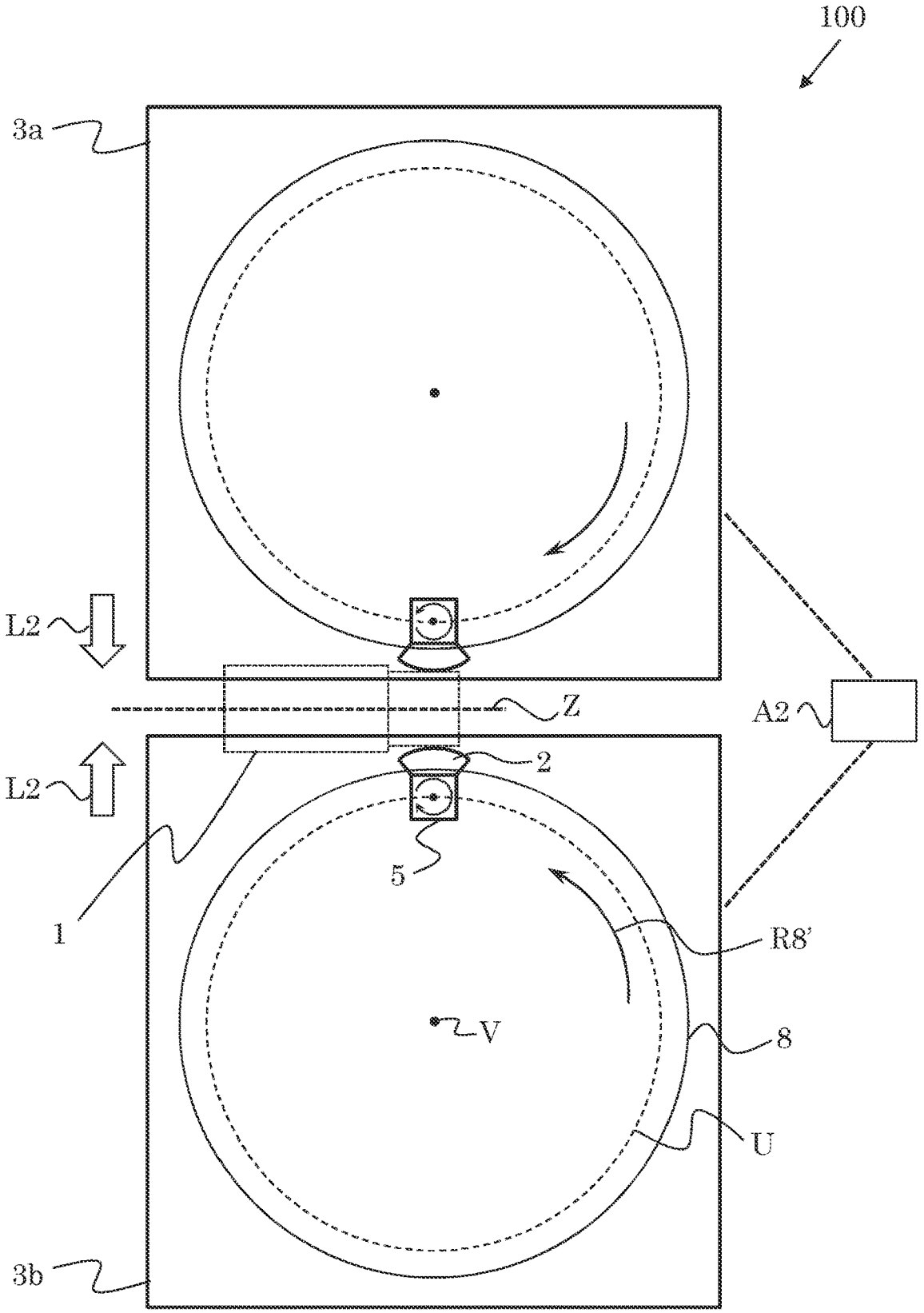
FIG. 5 a detail of an apparatus with two profiling heads, with a symbolised radial feed.

FIG. 5 illustrates a detail of an apparatus 100 with two profiling heads 3*a*, 3*b* wherein moreover yet a radial feed is symbolised. The orbiting bodies (each including at least one tool carrier) and, inasmuch as is provided, the planetary gear, can be mounted in the profiling heads 3*a*, 3*b*.

The profiling heads 3*a*, 3*b* or the parts that are mounted in them can be essentially of the same type but be designed in a mirror-imaged manner with regard to the movements.

The workpiece 1 (dashed), which is represented in a symbolised manner in FIG. 5, by way of this can be machined in a mirror-imaged manner by way of two tools that lie opposite one another with respect to the longitudinal axis Z.

The movements of the two orbiting bodies can accordingly be synchronised with one another or result from one and the same movement, for example from one and the same rotation drive. And one or more ring gears can be fixed in each of the profiling heads.

In the course of the machining, it can be advantageous if the tools can be fed radially thus in a direction perpendicular to the longitudinal axis, since the profile gaps that are in the process of emerging become deeper and deeper with an increasing number of engagements. This is also the case if only a single profiling head is provided or a tool engagement only takes place from one side or takes place simultaneously by no more than a single tool.

Such a radial feed movement is symbolised in FIG. 5 by the open arrows, which are indicated at L2. It can take place along an axis that runs perpendicularly to the longitudinal axis and is parallel to a plane that is described by the orbiting movement of the tool holder.

A drive A2 for the radial feed can be provided for this.

Figure 6A:
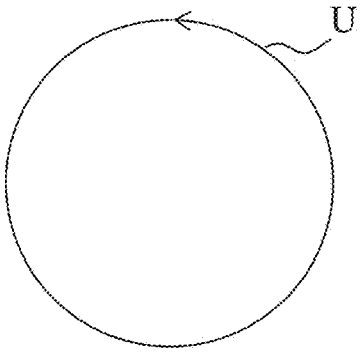
FIG. 6A an orbiting path of a tool holder.
Figure 6B:
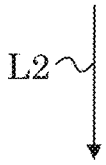
FIG. 6B a radial feed movement, symbolically.
Figure 6C:
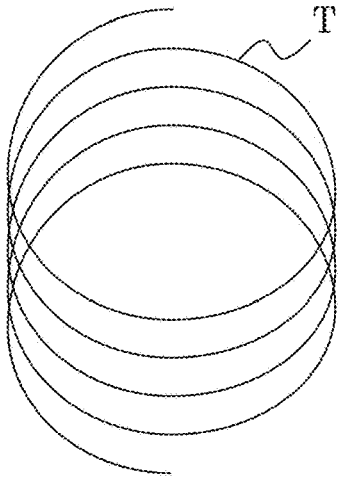
FIG. 6C a trajectory of a tool holder, as a superposition of an orbiting movement and a radial feed.

By way of the radial feed, the trajectory or movement path of the tool holder results from a superposition of the orbiting movement U with the (linear) radial feed movement as is schematically illustrated in FIG. 6A-6C.

Herein, FIG. 6A symbolises an orbiting path U of a tool holder

FIG. 6B symbolises a radial feed movement L2.

FIG. 6C symbolises a trajectory T of a tool holder, which results as a superposition of the orbiting movement U and the radial feed L2. Herein, in reality, the distances between the roughly circular trajectories constituents are very much smaller than are represented in FIG. 6C for the sake of clarity.

Figure 7:
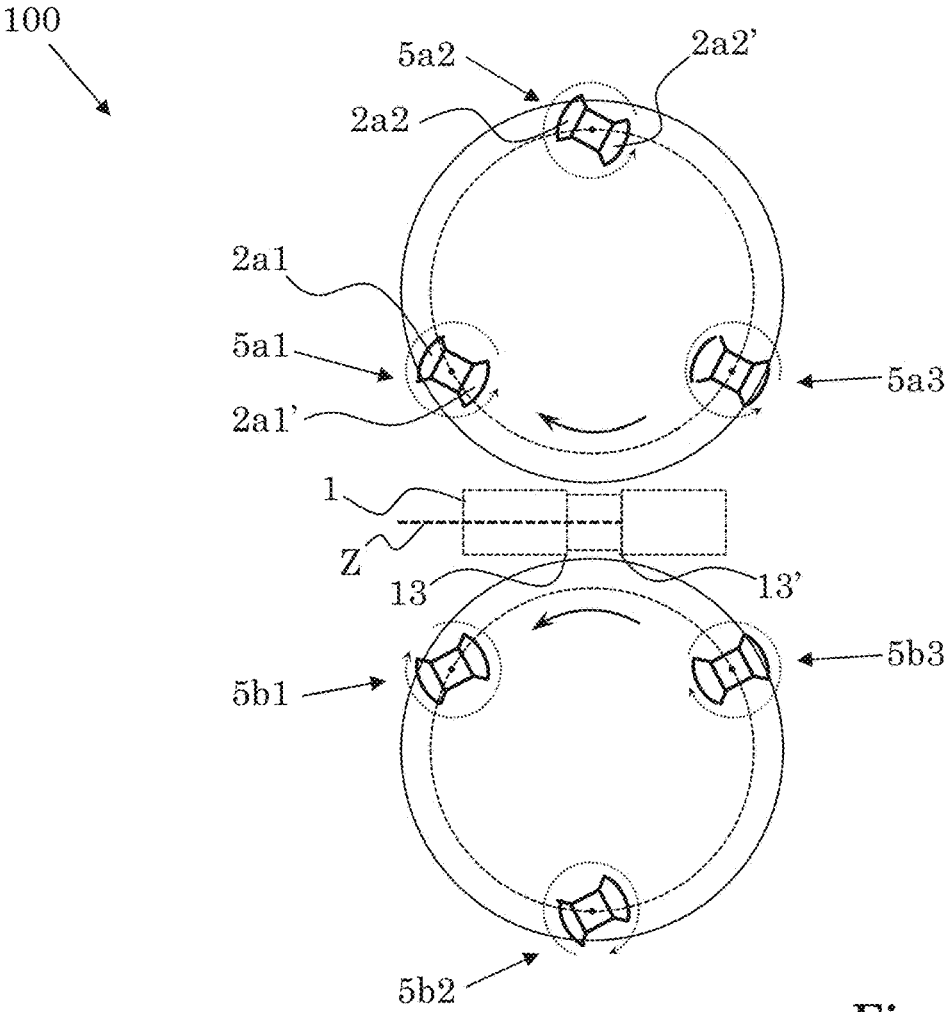
FIG. 7 a detail of an apparatus with two profiling heads which each include three tool holders each with two tools.

FIG. 7 illustrates a detail of an apparatus 100 with two profiling heads which each include three tool holders 5*a*1, 5*a*2, 5*a*3 and 5*b*1, 5*b*2, 5*b*3 each with two tools 2*a*1, 2*a*1' and 2*a*2, 2*a*2' respectively.

By way of (possibly per profiling head) several tool holders 5*a*1, 5*a*2, . . . being provided, several engagements can take pace per orbit of an orbiting body, which leads to a quicker machining and can therefore render possible a creation of the profiling within a short time By way of several tools being provided per tool holder, their service life can be increased and hence a longer interruption-free profiling is rendered possible. For example, the second synchronisation device S5 (see FIG. 1) can be configured such that given n tools per tool holder, after one orbit of the orbiting body 8, each of the tools at a certain position along the orbiting path U (see FIG. 1) of the tool carrier 5 (for example where the engagement with the workpiece 1 is to be terminated) has an azimuthal orientation that differs from the azimuthal position at the beginning of the orbiting by 360°/n. The difference can also be a multiple of 360°/n as long as this multiple is different from 360° and from a multiple of 360°.

It is further illustrated in FIG. 7 that profilings between two profiling delimitation structures, for example between two workpiece shoulders 13, 13', can also be created by way of the method, which is described in this text, wherein the profilings can each reach up to the profiling delimitation structures.

Figure 8:
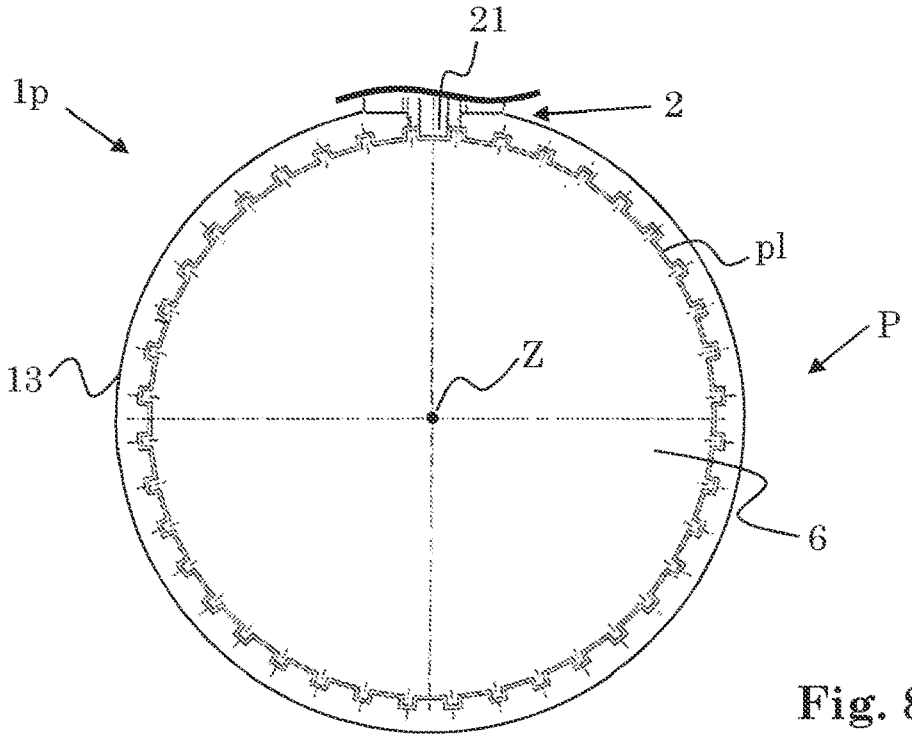
FIG. 8 a profile body with an outwardly projecting shoulder.

In a section perpendicular to the longitudinal axis Z, FIG. 8 shows a profile body 1*p* which includes a profiling P which can be produced by way of the described method or by way of the described apparatus. The profiling includes a multitude of profile gaps pl. Each of these profile gaps pl has arisen by way of successively carrying out a multitude of engagements of one or more tools 2, which each include an active region 21. Which, in the section according to FIG. 8, has a shape that corresponds essentially to the shape of a profile gap pl that is to be produced.

The profile body 1*p* is a hollow part, which is seated on an outwardly profiled mandrel 6 includes an outwardly projecting shoulder 13. On account of the use of a profiled mandrel 6, not only can an outer profiling be produced by the method, but also simultaneously yet an inner profiling.

Given solid parts or hollow parts which are seated on non-profiled mandrels, an outer profiling can be produced without an inner profiling being simultaneously co-produced.

Figure 9:
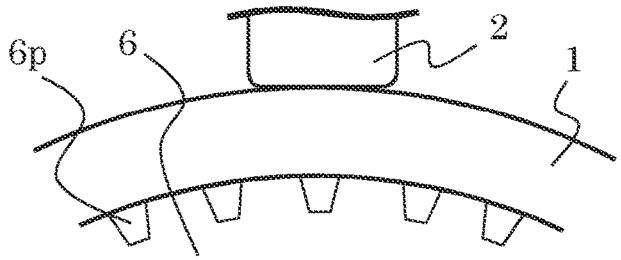
FIG. 9 a detail of a workpiece on an outer-profiled mandrel, in a section perpendicular to the longitudinal axis.

Furthermore, it is possible to produce an inner toothing in a hollow part, without an outer profiling being produced in the hollow part. FIG. 9 illustrates this.

FIG. 9 in a section perpendicular to the longitudinal axis show a detail of a workpiece 1 that is seated on an outer-profiled mandrel 6 and is just about to be machined by way of a tool 2 in the described manner. Material of the workpiece 1 is then shaped into profile gaps 6*p* by way of the machining. The tool 2 has an extensive active region.

Figure 10:
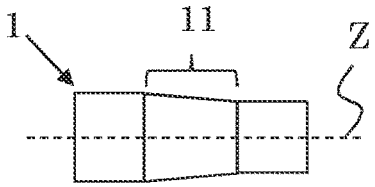
FIG. 10 a workpiece with a conical machining region, in a section which includes the longitudinal axis.
Figure 11:
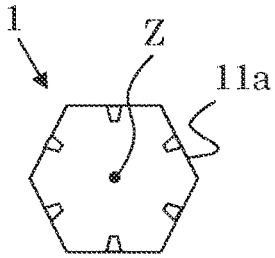
FIG. 11 a workpiece with a polygonal outer surface, in a section perpendicular to the longitudinal axis.

FIG. 10 is a section that contains the longitudinal axis Z and by way of an example shows that an outer surface of a machining region 11 of a workpiece 1 does not need to be designed cylindrically, but for example as represented, can be designed conically FIG. 11 in a section perpendicular to the longitudinal axis Z and by way of an example shows that an outer surface 11*a* of a machining region 11 of a workpiece 1 does not necessarily need to be rotationally symmetrical, but for example can be polygonal as represented. What is represented in FIG. 11 is the case that the outer surface 11 a includes six part-surfaces; however, one can also envisage the outer surface 11*a* including many more part-surfaces. The workpiece 1 can be designed for example prismatically in the associated machining region.

Figure 12:
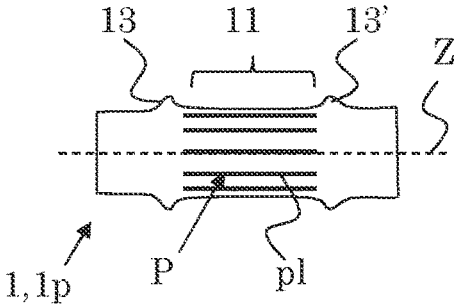
FIG. 12 a workpiece or a profile body with two axially distanced, radially outwardly directed profile delimitation structures, between which a profiling has been produced.

FIG. 12 shows an example of a workpiece 1 or a profile body 1*p* with two axially distanced profiling delimitation structures 13, 13' that stand radially outwards. The profiling P with its profile gaps pl which is produced by way of the described method reaches right up this these.

Figure 13:
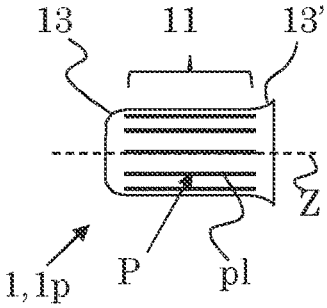
FIG. 13 a workpiece or a profile body with two axially distanced radially inwardly and radially outwardly directed profile delimitation structures, between which a profiling has been produced.

Profiling delimitation structures can also be directed radially inwards, relative to the adjacent section of the machining region. FIG. 13 shows an example of this, in which the profile delimitation structures 13 at an end of the machining region 12 are directed radially inwards and the profiling delimitation structures 13' at the other end of the machining region 11 are directed radially outwards.

Figure 14:
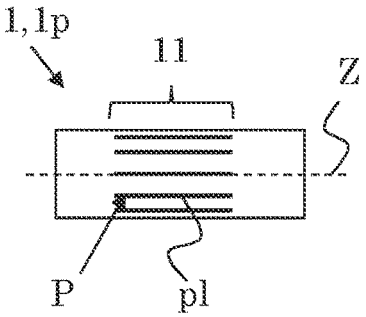
FIG. 14 a workpiece or a profile body without profiling delimitation structures.

FIG. 14 by way of an example illustrates that a machining region 11 does not necessarily need to be delimited at one or two sides by profiling delimitation structures. Shown is a profile body, where both ends of the machining regions 11 are not adjacent to the profiling delimitation structures.

Figure 15:
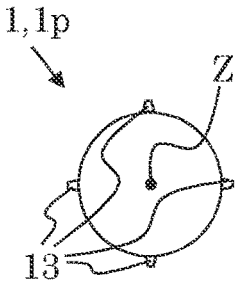
FIG. 15 a workpiece with non-rotationally symmetrical profiling delimitation structure, in a section perpendicular to the longitudinal axis.

FIG. 15 by way of example illustrates that a profiling delimitation structure 13 of a workpiece 1 is not necessary rotationally symmetrical. In the illustrated example, several radially outwardly projecting workpiece projections are provided which are localised at different azimuthal positions.

Figure 16:
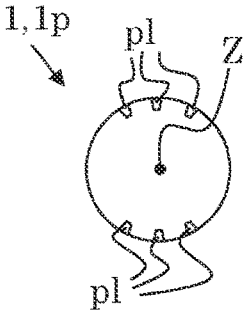
FIG. 16 a workpiece or a profile body with azimuthally non-uniformly distributed profile gaps, in a section perpendicular to the longitudinal axis.

In a section perpendicular to the longitudinal axis L, FIG. 16 illustrates a workpiece or a profile body 1*p* that has a profiling whose profile gaps 1*p* are distributed azimuthally in a non-uniform manner. Although profile gaps that are distributed uniformly over the periphery are preferred, there are applications for which an azimuthally irregular arrangement of profile gaps pl is advantageous.

Of course, a single workpiece can include two or more different machining regions, which for example can be axially distanced to one another and which are each provided with a profiling in the manner described in this text.

The invention claimed is:

1. A method for manufacturing a product body having a profiling, by way of cold reshaping a workpiece comprising a longitudinal axis and, a machining region and, in the machining region, an outer surface, wherein the profiling is to be produced in the outer surface, the method comprising the steps of:

executing a rotation movement of the workpiece about the longitudinal axis via a first drive device;

machining the workpiece by a first tool in a multitude of reshaping engagements that are carried out successively, in each of the reshaping engagements, an active region of the first tool coming into contact with the machining region;

holding the first tool by a first tool holder, wherein:

the first tool holder is mounted in an orbiting body, so as to be rotatable about a rotation axis of the first tool holder, driving the first tool holder via a second drive device so that the first tool holder carries out a rotating movement about the rotation axis, wherein azimuthal (ly), which is used hereinafter, is defined by the rotation axis; and the orbiting body executing a rotation about an orbiting body axis which is spaced from the rotation axis of the first tool holder and driving the first tool holder so that the first tool holder carries out an orbiting movement via a third drive device;

synchronizing the rotation movement of the workpiece with the orbiting movement of the first tool holder via a first synchronization device; and synchronizing the rotating movement of the first tool holder via a second synchronization device with the orbiting movement of the first tool holder.

2. The method according to claim 1, further comprising:

synchronizing the rotation movement of the workpiece with the orbiting movement of the first tool holder such that at each one of various different positions distributed over a circumference of the workpiece, a plurality of the reshaping engagements take place; and synchronizing the rotating movement of the first tool holder with the orbiting movement of the first tool holder such that the first tool runs through identical azimuths in each of the reshaping engagements.

3. The method according to claim 1, wherein the orbiting body axis and the rotation axis are aligned parallel to one another.

4. The method according to claim 1, the first tool holder describing a trajectory which results from a superposition of the orbiting movement with a feed movement which is directed radially towards the longitudinal axis.

5. The method according to claim 1, the active region of the first tool, when the first tool is held by the first tool holder, extending azimuthally over a sector only.

6. The method according to claim 1, the workpiece comprising a profiling delimitation structure adjacent the machining region, and the active region in each of the reshaping engagements coming into contact with the machining region right up to the profiling delimitation structure.

7. The method according to claim 1, wherein synchronizing the rotating movement of the first tool holder with the orbiting movement of the first tool holder is performed with a planetary gear.

8. The method according to claim 7, the planetary gear comprising a ring gear and a planet gear running in the ring gear, wherein the planet gear is part of the first tool holder, the first tool holder executing the rotating movement.

9. The method according to claim 1, further comprising simultaneously machining the workpiece by a second tool in a multitude of reshaping engagements, in each of the reshaping engagements an active region of the second tool coming into contact with the machining region.

10. The method according to claim 9, each of the successively carried out reshaping engagements of the second tool taking place at a position of the second tool which, with respect to the longitudinal axis, lies opposite the position of the workpiece at which simultaneously a reshaping engagement of the first tool takes place.

11. The method according to claim 1, comprising additionally machining the workpiece by a further tool in a multitude of reshaping engagements which are carried out successively, in each of the reshaping engagements an active region of the further tool coming into contact with the machining region.

12. The method according to claim 11, wherein the further tool is held by the same tool holder as the first tool.

13. The method according to claim 12, the active regions of the first tool and the further tool are azimuthally spaced from one another.

14. The method according to claim 11, further comprising providing a second tool holder which is different from the first tool holder, the second tool holder holding the further tool, the orbiting movement of the first tool holder describing an orbiting path which is identical to an orbiting path described by the orbiting movement an orbiting movement of the second tool holder.

15. The method according to claim 11, a tool holder holding the further tool carrying out the same orbiting movement as the first tool holder, wherein the tool holder is identical to the first tool holder or is different therefrom.

16. An apparatus for manufacturing a product body having a profiling, by way of cold reshaping a workpiece, wherein the apparatus comprises:

a workpiece holder that is rotatable about a longitudinal axis of the workpiece holder, for holding the workpiece;

a first drive device that rotates the workpiece holder about the longitudinal axis;

an orbiting body;

a first tool holder for holding a first tool, wherein the first tool holder is mounted in the orbiting body, so as to be rotatable about a rotation axis of the first tool holder;

a second drive device that rotates the first tool holder about a rotation axis of the first tool holder;

a third drive device that rotates the orbiting body about an orbiting body axis which is spaced from the rotation axis of the first tool holder by way of which the first tool holder is drivable to carry out an orbiting movement;

a first synchronisation device that synchronizes rotational movement of the workpiece holder with the orbiting movement of the first tool holder; and a second synchronisation device that synchronizes rotational movement of the first tool holder with the orbiting movement of the first tool holder.

17. The apparatus according to claim 16, comprising a planetary gear which is a constituent of the second synchronisation device and/or is a constituent of the second drive device for producing a rotating movement of the first tool holder about the rotation axis.

18. The apparatus according to claim 16, wherein the orbiting body is mounted in a profiling head, and wherein the apparatus comprises a drive that moves the profiling head towards the longitudinal axis.

* * * * *